US011235390B2

(12) United States Patent
Yamagata et al.

(10) Patent No.: US 11,235,390 B2
(45) Date of Patent: Feb. 1, 2022

(54) APPARATUS FOR PRODUCING METAL POWDER AND METHOD OF PRODUCING METAL POWDER

(71) Applicants: HARD INDUSTRY YUGEN KAISHA, Hachinohe (JP); HITACHI METALS, LTD., Tokyo (JP)

(72) Inventors: Torao Yamagata, Hachinohe (JP); Takuichi Yamagata, Hachinohe (JP); Hiroshi Izaki

(73) Assignees: HARD INDUSTRY YUGEN KAISHA, Hachinohe (JP); HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/644,915

(22) PCT Filed: Sep. 4, 2018

(86) PCT No.: PCT/JP2018/032785
§ 371 (c)(1),
(2) Date: Mar. 5, 2020

(87) PCT Pub. No.: WO2019/049865
PCT Pub. Date: Mar. 14, 2019

(65) Prior Publication Data

US 2020/0261981 A1 Aug. 20, 2020

(30) Foreign Application Priority Data

Sep. 7, 2017 (JP) ..... JP2017-172411

(51) Int. Cl.
*B22F 1/00* (2006.01)
*B22F 9/08* (2006.01)

(52) U.S. Cl.
CPC ..... *B22F 9/082* (2013.01); *B22F 2009/084* (2013.01); *B22F 2009/0828* (2013.01); *B22F 2009/0892* (2013.01)

(58) Field of Classification Search
CPC ..... B22F 9/00; B22F 9/06; B22F 2009/0888; B22F 2009/0896
See application file for complete search history.

(56) References Cited

FOREIGN PATENT DOCUMENTS

GB 2281233 A * 3/1995 ..... B22F 9/082
JP 10121115 A 5/1998
(Continued)

OTHER PUBLICATIONS

European Extended Search Report dated Dec. 15, 2020 on corresponding European Patent Application No. 18854477.

*Primary Examiner* — Joseph S Del Sole
*Assistant Examiner* — Thu Khanh T Nguyen
(74) *Attorney, Agent, or Firm* — Polsinelli PC; Ron Galant

(57) ABSTRACT

To provide an apparatus for producing a metal powder and a method of producing a metal powder capable of obtaining a metal powder having a finer particle size of excellent quality. A supersonic combustion flame is intensively injected into a downwardly supplied molten metal, the intensive combustion flame is jetted directly downwardly as a focused jet flow, the focused jet flow thrusts into a turning water flow formed along an inner peripheral surface of a pulverization cooling cylinder whose axis line is inclined from a vertical direction, and an intensive position of the combustion flame is in an open space above the turning water flow.

3 Claims, 5 Drawing Sheets

(56) References Cited

FOREIGN PATENT DOCUMENTS

| | | | | |
|---|---|---|---|---|
| JP | 11043707 | A | | 2/1999 |
| JP | 11080812 | A | * | 3/1999 |
| JP | 11080812 | A | | 3/1999 |
| JP | 2010090410 | A | | 4/2010 |
| JP | 2014 136807 | A | | 7/2014 |
| JP | 2014136807 | A | * | 7/2014 |
| JP | 2016 204718 | A | | 12/2016 |
| JP | 2017 145442 | A | | 8/2017 |

* cited by examiner

APPARATUS FOR PRODUCING METAL POWDER AND METHOD OF PRODUCING METAL POWDER

TECHNICAL FIELD

The present disclosure relates to an apparatus for producing a metal powder and a method of producing a metal powder.

BACKGROUND ART

As a method of producing a metal powder, a gas atomizing method of injecting a high-pressure gas into a molten metal that is supplied downwardly to produce a metal powder or a water atomizing method of injecting high-pressure water into a molten metal that is supplied downwardly to produce a metal powder has been known. As a method of producing a metal powder using the gas atomizing method, a method of injecting a high-pressure gas into a molten metal that is supplied downwardly, dividing (firstly pulverizing) the molten metal into fine droplets, thrusting the divided droplets into a revolving water flow, and dividing (secondly pulverizing) and cooling the droplets into fine droplets has been known (for example, Japanese Patent Application Laid-Open (JP-A) No. H10-121115, JP-A No. H11-43707, JP-A No. H11-80812, and JP-A No. 2010-90410).

In the method of producing a metal powder described in the above patent documents, for example, a metal powder having a fine particle size is produced by flowing cooling water downward with revolving the cooling water to form a revolving water flow along an inner peripheral wall of a cylindrical pulverization cooling cylinder whose axis line is inclined relative to a vertical direction, thrusting droplets, which was firstly divided (firstly pulverized) with a high-pressure gas, into the revolving water flow together with a gas flow, and secondly dividing (secondly pulverizing) and cooling the droplets.

SUMMARY OF INVENTION

In the method of producing a metal powder described in the above patent documents, since a temperature of the high-pressure gas (atomized gas) injected into the molten metal is extremely lower than that of the molten metal, the molten metal is pulverized while being cooled. For this reason, the molten metal is pulverized while a viscosity of the molten metal increases, and even if an injected gas pressure is increased, it is difficult to pulverize the molten metal more finely. That is, there is a limit in obtaining a metal powder having a finer particle size.

In the method of producing a metal powder described in the above patent documents, since the firstly divided droplets are thrust into the revolving water flow together with the high-pressure gas that was spread due to an injection angle, there is variation in a distance (time) until the droplets are thrust into the revolving water flow. Since the firstly divided droplets are thrust into the revolving water flow while being cooled with the high-pressure gas, if there is variation in a distance (time) until the firstly divided droplets are thrust into the revolving water flow, there is variation in quality of the metal powder, for example, amorphization of the metal powder, which is affected by a cooling rate of the droplets.

The disclosure has been made in view of the above-described problems, and an object of the present disclosure is to provide an apparatus for producing a metal powder and a method of producing a metal powder that are capable of obtaining a metal powder having a fine particle size of excellent quality.

An apparatus for producing a metal powder according to a first aspect includes: a supply unit that downwardly supplies a molten metal; a combustion flame injection unit that convergently injects a supersonic combustion flame from a combustion flame injection port to a molten metal supplied from the supply unit and jets the convergent combustion flame as a focused jet flow directly downward; and a pulverization device having a pulverization cooling cylinder that forms a revolving water flow along an inner peripheral wall of the pulverization cooling cylinder, which has an axis line that is inclined relative to a vertical direction, and that thrusts the focused jet flow inflowing from an upper opening into the revolving water flow. A convergence position of the combustion flame is in an open space above the opening.

According to the apparatus for producing a metal powder according to the first aspect, the supersonic combustion flame from the combustion flame injection port is convergently injected to the molten metal supplied from the supply unit, and as a result, a combustion flame gas can convergently collide with the molten metal. As a result, the supplied molten metal is pulverized by a high collision energy of a supersonic gas. The molten metal is pulverized while being heated by the combustion flame, that is, while being reduced in viscosity, and as a result, the metal powder having a fine particle size can be easily obtained.

According to the apparatus for producing a metal powder according to the first aspect, the supplied molten metal is pulverized (firstly pulverized) at the convergence position of the combustion flame to form the droplets, and a temperature of the droplets becomes higher than that of the molten metal and the droplets can move by being carried on the focused supersonic jet flow. As a result, an inertia force acts on massive droplets, a large velocity difference between the droplets and the focused jet flow occurs, and the firstly pulverized droplets are elongated and are subjected to a tearing force, until the droplets reach the revolving water flow, and re-pulverized (secondly pulverized), and as a result, the metal powder having a finer particle size can be obtained.

In the apparatus for producing a metal powder according to the first aspect, the convergence position of the combustion flame is in an open space above the opening of the pulverization cooling cylinder. As a result, the distance from the convergence position of the combustion flame to the revolving water flow becomes long, the time of the secondary pulverization becomes long, and the droplets are easily spheroidized, and as a result, the metal powder that is close to a sphere and has a fine particle size can be obtained.

By configuring the convergence position of the combustion flame in the open space above the opening of the pulverization cooling cylinder, a smoother airflow is formed around an upstream portion of the focused jet flow, and thus a generation of a negative pressure is suppressed. As a result, the focused jet flow is suppressed from unstably vibrating due to being pulled by the negative pressure, which is irregularly generated. It is possible to obtain the metal powder having a fine particle size in which the variation in the quality of the metal powder that is caused by the secondary pulverization, for example, the spread of the particle size distribution, is suppressed.

By increasing the distance from the convergence position of the combustion flame to the revolving water flow of the pulverization cooling cylinder, the droplets stay in the high-temperature combustion flame for a long time. As a result, the gas entangled in the droplets during the firstly pulverization or the gas generated in the droplets is easily discharged to the outside of the droplets, and the metal powder having a fine particle size in which the number of internal pores is small can be obtained.

Since the droplets stays in the high-temperature combustion flame for a long time, even if other droplets come into contact with a droplet, these droplets are easily united into one droplet. This makes it difficult to form a metal powder in a state referred to as a so-called "satellite" in which fine metal particles adhere to the metal particles, and as a result, it is possible to obtain the metal powder having a fine particle size and excellent fluidity.

In the apparatus for producing a metal powder according to the first aspect, the supersonic combustion flame is convergently injected from a fuel flame injection port to a supplied molten metal. Due to the characteristics of the supersonic gas flow, the convergent combustion flame is jet linearly vertically downward as the focused supersonic jet flow. As a result, the variation in the distance (time) from the firstly pulverization of the molten metal to the thrusting of the molten metal into the revolving water flow, that is, variation of the distance (time) of the secondly pulverization is suppressed, and as a result, it is possible to obtain the metal powder having a fine particle size in which the variation in the quality of the metal powder that is affected by the secondary pulverization, for example, the spread of the particle size distribution, is suppressed.

In the apparatus for producing a metal powder according to the first aspect, the re-pulverization (thirdly pulverization) can be performed by the impact when the droplets that are secondly pulverized by the focused jet flow thrust into the revolving water flow or by the impact when the droplets flowing by being carried in the revolving water flow collide with the inner wall of the pulverization cooling cylinder. As a result, the metal powder having a finer particle size can be obtained.

According to the apparatus for producing a metal powder according to the first aspect, the droplets that are secondly pulverized can be cooled by thrusting into the revolving water flow together with the focused jet flow in which the high-temperature combustion flame is focused. That is, the droplets that is secondly pulverized can thrust into the revolving water flow while being heated by the combustion flame and maintained at a high temperature. As a result, it is possible to obtain the metal powder having a fine particle size in which the cooling variation of the droplets is suppressed, and the variation in the quality of the metal powder, such as the stable amorphization, is suppressed. The quality of the metal powder is affected by the cooling rate of the droplets.

As described above, according to the apparatus for producing a metal powder according to the first aspect, it is possible to obtain the metal powder having a fine particle size of excellent qualities such as sphericity and favorable fluidity of the metal powder, poreless inside the powder, the particle size distribution in which the spread of the distribution is suppressed, and the stable amorphization.

According to an apparatus for producing a metal powder according to a second aspect, in the apparatus for producing a metal powder according to the first aspect, the convergence position of the combustion flame is above the axis line of the pulverization cooling cylinder.

According to the apparatus for producing a metal powder according to the second aspect, even if an inner diameter of the pulverization cooling cylinder decreases, the distance from the convergence position of the combustion flame to the revolving water flow can be long, that is, the time of the secondary pulverization can be long. As a result, the metal powder having a fine particle size can be obtained even with a simpler apparatus having the small inner diameter of the pulverization cooling cylinder and a small capacity of a water supply source for generating the revolving water flow.

According to an apparatus for producing a metal powder according to a third aspect, in the apparatus for producing a metal powder according to the second aspect, the convergence position of the combustion flame is above a virtual horizontal plane passing through an upper end edge of the pulverization cooling cylinder.

In the apparatus for producing a metal powder according to the third aspect, an airflow flows almost uniformly around an upstream portion of the focused jet flow from all sides, and a smooth airflow is formed around the upstream portion of the focused jet flow. As a result, since the generation of the negative pressure around the upstream portion of the focused jet flow is further suppressed and thus the vibration of the focused jet f low is further suppressed, it is possible to obtain the metal powder having a fine particle size in which the variation in the quality of the metal powder that is affected by the secondary pulverization, for example, the spread of the particle size distribution, is suppressed According to an apparatus for producing a metal powder according to the fourth aspect, in the apparatus for producing a metal powder according to any one of the first to third aspects, the convergence position is in a range of 15 to 120 mm from the lower end of the combustion flame injection port.

According to an apparatus for producing a metal powder according to a fifth aspect, in the apparatus for producing a metal powder according to any one of the first to fourth aspects, an inclination angle of the axis line of the pulverization cooling cylinder with respect to the vertical direction is from 10° to 55°, and the tip of the combustion flame injection port is above the virtual horizontal plane passing through the upper end edge of the pulverization cooling cylinder.

In a method of producing a metal powder according to a sixth aspect, a supersonic combustion flame is convergently injected into a molten metal that is downwardly supplied, the convergent combustion flame is jetted directly below as the focused jet flow, the focused jet flow thrusts into the revolving water flow formed along an inner peripheral surface of a pulverization cooling cylinder, which has an axis line that is inclined relative to a vertical direction, and the convergence position of the combustion flame is in an open space above the revolving water flow.

According to a method of producing a metal powder according to a seventh aspect, in the method of producing a metal powder according to the sixth aspect, the convergence position of the combustion flame is above the axis line of the pulverization cooling cylinder.

According to a method of producing a metal powder according to an eighth aspect, in the method of producing a metal powder according to the seventh aspect, the convergence position of the combustion flame is above a virtual horizontal plane passing through an upper end edge of the pulverization cooling cylinder.

According to a method of producing a metal powder according to a ninth aspect, in the method of producing a metal powder according to any one of the sixth to eighth aspects, an airflow flows into the upstream portion of the focused jet flow from all sides.

According to a method of producing a metal powder according to a tenth aspect, in the method of producing a metal powder according to any one of the sixth to ninth aspects, the inclination angle of the axis line of the pulverization cooling cylinder with respect to the vertical direction is from 10° to 55°, and the tip of the combustion flame injection port that injects the combustion flame is above the virtual horizontal plane passing through the upper end edge of the pulverization cooling cylinder.

In a method of producing a metal powder according to an eleventh aspect, the method includes: a first pulverizing step of convergently injecting a supersonic combustion flame into a downwardly supplied molten metal and firstly pulverizing the molten metal to form molten droplets; a second pulverizing step of jetting the combustion flame as a focused jet flow including the firstly pulverized droplets directly downward, moving the firstly pulverized droplets in the focused jet flow, which has a relatively fast speed, and secondly pulverizing the droplets to form smaller molten droplets; and a third pulverizing step of thrusting the focused jet flow including the secondly pulverized droplets into a revolving water flow and thirdly pulverizing and cooling the focused jet flow to make a metal powder smaller than the secondly pulverized droplets.

According to a method of producing a metal powder according to a twelfth aspect, in the method of producing a metal powder according to the eleventh aspect, the airflow equally flows into an upstream portion of the focused jet flow from all sides.

The actions and effects of the sixth to eighth aspects overlap with the actions and effects of the first to third aspects, and a description thereof will not be repeated.

According to the apparatus for producing a metal powder and the method of producing a metal powder of the disclosure, it has an effect that the metal powder having the fine particle size of excellent quality can be obtained.

DESCRIPTION OF EMBODIMENTS

An apparatus 10 for producing a metal powder according to an embodiment of the present invention will be described with reference to FIGS. 1 to 3.

Figure 1:
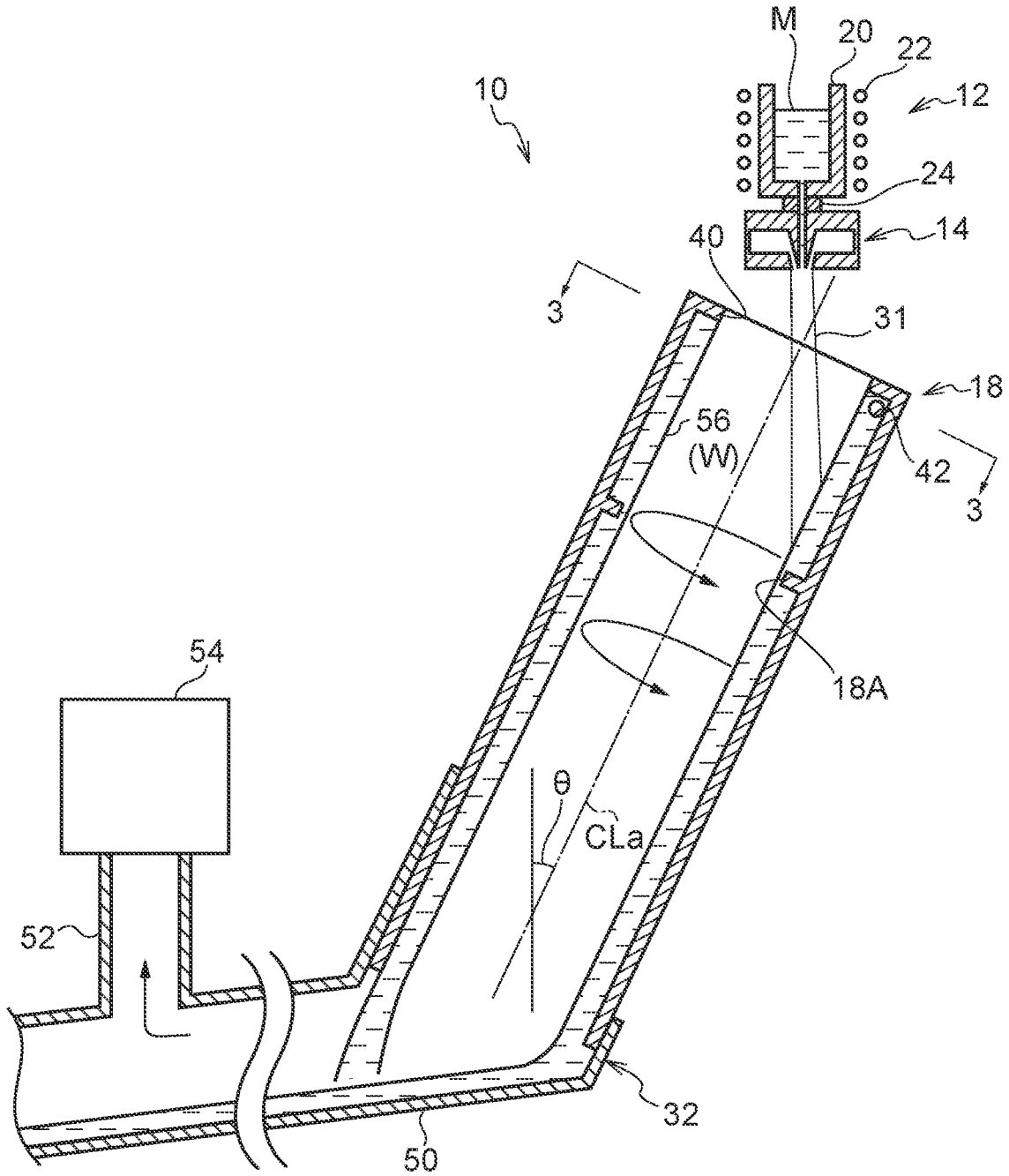
FIG. 1 is a vertical cross-sectional view showing an apparatus for producing a metal powder according to an embodiment of the present invention.

As shown in FIG. 1, an apparatus 10 for producing a metal powder is configured to include a supply unit 12 that supplies a molten metal M, a combustion flame injection unit 14 that pulverizes (primary pulverization of the invention) the molten metal M to generate droplets Mmp, a pulverization cooling cylinder 18 that re-pulverizes (tertiary pulverization of the invention) and cools the droplets Mmp and generates a metal powder Msp, and the like. In the apparatus 10, the supply unit 12, the combustion flame injection unit 14, and the pulverization cooling cylinder 18 are disposed in an open space thereof. That is, there is a space through which an atmospheric gas (for example, air) around the apparatus can freely flow between the combustion flame injection unit 14 and the pulverization cooling cylinder 18.

The supply unit 12 includes a container 20 that stores the molten metal M, and a high frequency coil 22 that heats and melts a metal material to form a molten metal M is disposed at an outer peripheral side of the container 20. The supply unit 12 has a pouring nozzle 24 that is disposed at a lower center of a bottom surface of the container 20 and that communicates with an inside of the container 20, and the molten metal M stored inside the container 20 can be supplied downwardly from the pouring nozzle 24.

Figure 2:
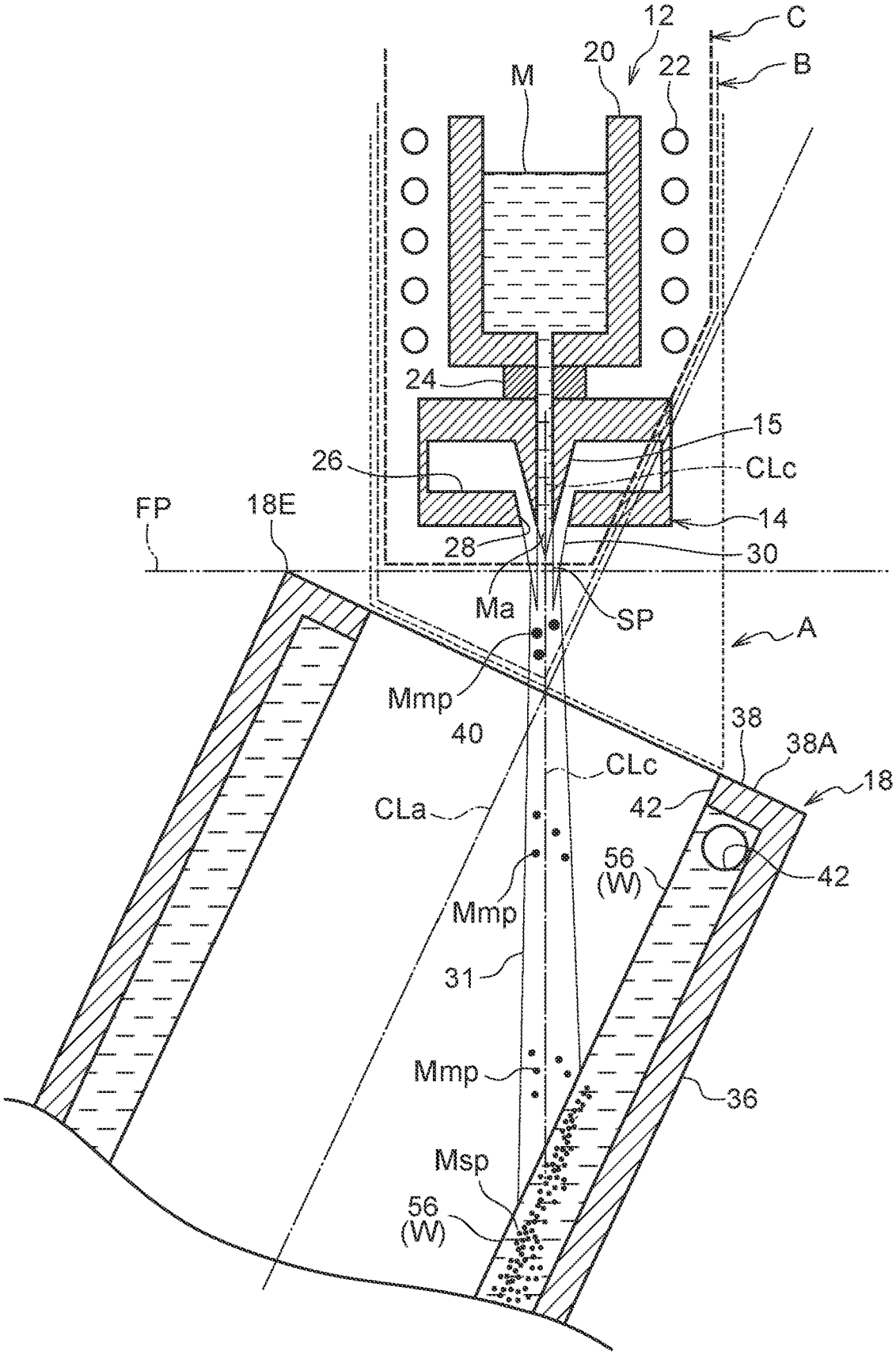
FIG. 2 is an enlarged vertical cross-sectional view of an upper portion of the apparatus for producing a metal powder according to the embodiment of the invention.

As shown in FIG. 2, the combustion flame injection unit 14 is located below the supply unit 12 and has a conical passage part 15 for supplying the molten metal M at a center thereof. The combustion flame injection unit 14 includes an annular combustion chamber 26 and a combustion flame injection port 28 that injects a combustion flame 30. The combustion flame injection port 28 is formed in an annular shape when viewed from an axial direction, and coaxially disposed with the passage part 15 so as to surround an outer peripheral side of the passage part 15 along the passage part 15 formed in a conical shape. A diameter of the combustion flame injection port 28 gradually decreases by extending from the combustion chamber 26 downward.

The combustion flame injection unitl4 is different from the high-pressure gas injection unit described in the patent documents. Air and kerosene, which is a hydrocarbon, are mixed and combusted inside the combustion chamber 26 and the combustion flame 30 can be injected inwardly and downwardly from the combustion flame injection port 28 without any gap along a circumference of the combustion flame injection port 28. Note that the combustion flame 30 is injected as a supersonic gas flow at a temperature higher than a melting point of the molten metal M.

The combustion flame injection unit 14 can inject the combustion flame 30 obliquely downward from the annular combustion flame injection port 28 at lower side of the supply unit 12. In other word, the combustion flame 30 is injected toward an extension line that is extended downward from an axis line of the passage part 15. The combustion flame injection unit 14 can convergently inject the combustion flame 30 into one spot (hereinafter, convergence position SP where the combustion flame 30 is concentrated at the supplied flow Ma) of supplied flow Ma of the molten metal M that is supplied from the pouring nozzle 24 with the combustion flame 30 surrounding the supplied flow Ma.

The combustion flame injection unit 14 can convergently inject the combustion flame 30 at an even injection pressure without any gap along an outer periphery of the supplied flow Ma of the molten metal M that is supplied from the pouring nozzle 24. The combustion flame 30 can be convergently collide at the convergence position SP of the supplied flow Ma.

Moreover, the combustion flame injection unit 14 can convergently inject the combustion flame 30 at a supersonic speed, and can jet the convergent combustion flame 30, which is a linear focused jet flow 31 whose spread is suppressed, vertically downward from the convergence position SP. That is, a diameter of the supersonic combustion flame 30 gradually decreases by injected downwardly from the combustion flame injection port 28, and as an example, the supersonic combustion flame 30 is concentrated at a position 15 to 120 mm below from a lower end of the combustion flame injection port 28 and the diameter of the supersonic combustion flame 30 becomes minimum and then slightly increases, but the supersonic combustion flame 30 flows downward as a focused jet flow 31 without widely spreading like gas atomize. Note that the convergence position SP of the combustion flame 30 can be visually confirmed as a position where the diameter of the combustion flame 30 becomes minimum when the combustion flame 30 is viewed from a side.

When the combustion flame 30 collides with the convergence position SP of the supplied flow Ma, the molten metal M is firstly pulverized, and the molten metal powder micronized in a mist form, that is, the droplets Mmp is generated. Then, the focused jet flow 31 including the droplets Mmp flows downward along an extension line of an axis line CLc of the combustion flame injection unit 14 while maintaining a supersonic speed or a high speed close to the supersonic speed.

Note that, since the droplets Mmp generated by the primary pulverization is a liquid having a mass, an inertial force acts, and a downward flow velocity of the droplets Mmp is lower than that of the focused jet flow 31, which is a gas. The droplets Mmp, which flow downward, are subjected to a force that pulls and tears the droplets Mmp by the focused jet flow 31 having a relatively fast speed, and the droplets Mmp are re-pulverized (secondary pulverization of the invention) and micronized.

The pulverization cooling cylinder 18 is located below the combustion flame injection unit 14 and includes a cylindrical part 36 in which the axis line CLa is inclined relative to the vertical direction, and an annular closing member 38 that closes an outer periphery of an upper portion of the cylindrical part 36. A circular opening 40, which is coaxial with the pulverization cooling cylinder 18, is formed at a central portion of the closing member 38. Note that an inclination angle θ of the axis line CLa of the pulverization cooling cylinder 18 with respect to the vertical direction is preferably in a range from 10° to 55°.

Figure 3:
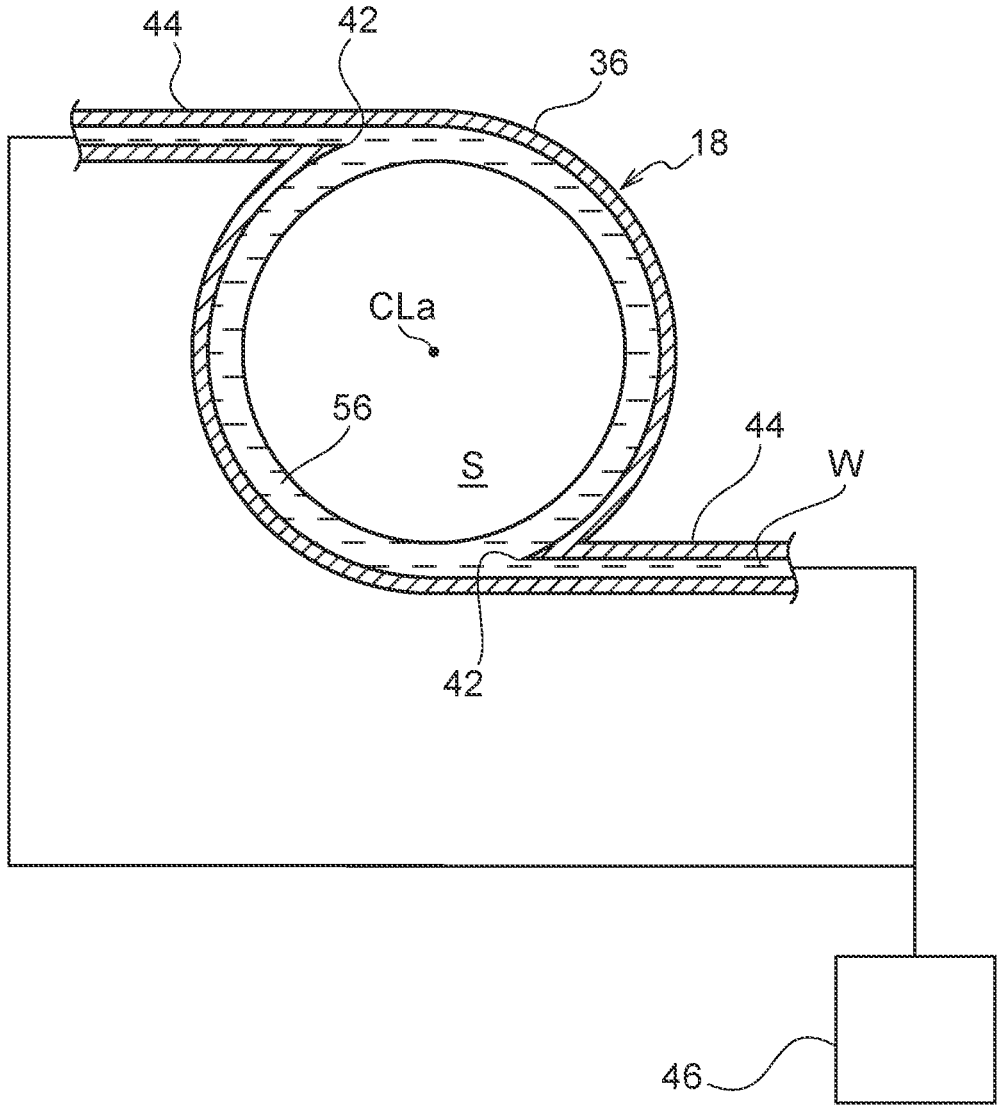
FIG. 3 is a cross-sectional view of the apparatus for producing a metal powder shown in FIG. 1, taken along line 3-3.

As shown in FIGS. 1 and 3, in the pulverization cooling cylinder 18, two cooling water injection ports 42 open at an upper end side of the cylindrical part 36, and as shown in FIG. 3, the two cooling water injection ports 42 are located at opposite sides to each other with respect to the axis line CLa of the pulverization cooling cylinder 18. The two cooling water injection ports 42 are connected to a water supply source 46 via pipes 44 that respectively extends along a tangential direction on an inner peripheral surface of the cylindrical part 36. The water supply source 46 includes a pump, a flow rate control valve, and the like, and can jet a large amount of cooling water W at a high speed along the tangential direction of the inner peripheral surface of the cylindrical part 36 via the each cooling water injection port 42.

When the cooling water W is jetted from the cooling water injection port 42, the cooling water W flows down while revolving at a high speed along the inner peripheral surface of the pulverization cooling cylinder 18, and a revolving cooling water layer 56 is formed. The cooling water W flows down while revolving at a high speed along the inner peripheral surface of the pulverization cooling cylinder 18, and is discharged from a lower end of the pulverization cooling cylinder 18 to a discharge part 32. The closing member 38 prevents the revolving cooling water W from being discharged to an upper side of the pulverization cooling cylinder 18.

The pulverization cooling cylinder 18 has an annular projection 18A, which is disposed at the inner peripheral surface of the cylinder 18, for adjusting a layer thickness of the revolving cooling water layer 56. The downward flow of the cooling water W is suppressed and the revolving cooling water layer 56 having a substantially constant thickness is easily formed between the cooling water injection ports 42 and the projection 18A with a small amount of the cooling water W. At the same time, a shape of a cavity S formed at a center side of the revolving cooling water layer 56 is stabilized. In the present embodiment, the pulverization cooling cylinder 18 and the water supply source 46 constitute a pulverization device.

Next, a positional relationship between the combustion flame injection unit 14 and the pulverization cooling cylinder 18 will be described.

As shown in FIG. 2, in the apparatus 10 for producing a metal powder of the present embodiment, the combustion flame injection unit 14 is located vertically above the opening 40 of the pulverization cooling cylinder 18, and the convergence position SP of the combustion flame 30, which is injected from the combustion flame injection port 28, is located below the lower end of the combustion flame injection port 28 in an open area A. The open area A is indicated by surrounded by a thin dotted line in FIG. 2.

Preferably, the convergence position SP is located in an area B within the area A and the area B is indicated by surrounded by a long dotted line above the axis line CLa of the pulverization cooling cylinder 18.

It is more preferable that the convergence position SP is located in an area C within the area B and the area C is indicated by surrounded by a thick dotted line above a virtual horizontal plane FP, which contacts an upper end edge portion 18E of the pulverization cooling cylinder 18.

By adopting such locations of the convergence position SP, a distance from the convergence position SP to the revolving cooling water layer 56 increases, and a time for secondly pulverizing the droplets Mmp increases, and as a result, the secondary pulverization of the droplets Mmp can be efficiently performed.

As shown in FIG. 1, the discharge part 32 has a pipe 50 which is connected to the lower end of the pulverization cooling cylinder 18 and is inclined, and a pipe 52 extending upward is connected to an intermediate part of the pipe 50. A suction device 54 that sucks an exhaust gas (for example, gas generated by combusting kerosene and air) inside the pulverization cooling cylinder 18 is connected to an end portion of the pipe 52, and the suction device 54 is configured to include a blower or the like.

(Action and Effect)

Next, the operation, an action, and effect of the apparatus 10 for producing a metal powder of the present embodiment will be described.

In the procedure of producing a metal powder Msp by the apparatus 10, first, a metal material is charged into the container 20 and heated and molten by the high frequency coil 22 to produce the molten metal M. At this time, the passage part 15 leading from the inside of the container 20 to the combustion flame injection port 28 is closed by a valve (not shown), and the molten metal M is not supplied downwardly at the passage part 15.

Next, a large amount of cooling water W is jetted at a high speed from the cooling water injection ports 42, and the cooling water W flows down while revolving at high speed along the inner peripheral surface of the pulverization cooling cylinder 18, thereby forming the revolving cooling water layer 56 which is the revolving water flow. The cooling water W forming the revolving cooling water layer 56 flows down while revolving along the inner peripheral surface of the pulverization cooling cylinder 18, and is discharged from the lower end of the pulverization cooling cylinder 18 to the discharge part 32.

Next, after the suction device 54 is activated and the gas inside the pulverization cooling cylinder 18 can be exhausted, the combustion flame 30 is injected from the combustion flame injection port 28 of the combustion flame injection unit 14. A valve (not shown) of the container 20 is opened, and the molten metal M in the container 20 flows out vertically downward from the pouring nozzle 24 as a downward flow Ma. Thereby, the combustion flame 30 is convergently injected into the convergence position SP of the downward flow Ma, the combustion flame 30 collides with the convergence position SP of the downward flow Ma, and the downward flow Ma is firstly pulverized by the collision energy of the combustion flame 30, and the mist-like fine droplets Mmp is generated. The exhaust gas generated together with the combustion flame 30 is sucked into the suction device 54 through the inside of the pulverization cooling cylinder 18 and discharged to an outside.

In a case in which the combustion flame injection unit 14 is a gas injection unit as described in the patent documents, the high-pressure gas (atomized gas) is at a lower temperature than the downward flow Ma, and a jet speed of gas is also lower than the present embodiment. Therefore, since the downward flow Ma is pulverized while being cooled by the high-pressure gas, that is, while increasing the viscosity of the downward flow Ma, the downward flow Ma becomes difficult to be pulverized, the droplets Mmp having the fine particle size is hardly generated.

However, in the present embodiment, the combustion flame injection unit 14 can pulverize (firstly pulverize) the downward flow Ma while heating the downward flow Ma with the high-temperature combustion flame 30, that is, while reducing the viscosity of the downward flow Ma. It is possible to pulverize the downward flow Ma with high impact energy of the combustion flame 30 by convergently injecting the supersonic combustion flame 30. As a result, the downward flow Ma can be easily pulverized, and the droplets Mmp having a finer particle size than the method of producing a metal powder disclosed in the patent document can be obtained.

The combustion flame 30, which is convergently injected into the convergence position SP of the downward flow Ma, flows linearly downward from the convergence position SP as the focused jet flow 31 whose spread is suppressed due to the characteristics of the supersonic gas flow. At this time, the droplets Mmp, which is generated in the mist form by the primary pulverization, flows vertically downward while maintaining a supersonic speed or a speed close to the supersonic speed together with the focused jet flow 31.

In the event that the combustion flame injection unit 14 is the gas injection unit as described in the patent documents, the high-pressure gas (atomized gas) is at a lower temperature than the droplets Mmp, and a jet speed of the gas is also lower than the present embodiment. Therefore, the droplets Mmp generated by the primary pulverization flows downward while being cooled, that is, while increasing the viscosity of the droplets Mmp. It is difficult to perform the continuous pulverization even if a relative speed difference between the droplets Mmp and the high-pressure gas occurs.

However, in the apparatus 10 for producing a metal powder of the present embodiment, the droplets Mmp can flow downward together with the high-temperature and high-speed focused jet flow 31 by the combustion flame injection unit 14. That is, by the heating of the focused jet flow 31, the droplets Mmp can flow downward while the viscosity of the droplets Mmp is lowered and a relative speed difference from the focused supersonic jet flow 31 is generated at the droplets Mmp. As a result, the droplets Mmp can be secondly pulverized easily in a distance from the convergence position SP to the revolving cooling water layer 56, and the fine droplets Mmp can be generated.

In the apparatus 10 for producing a metal powder of the present embodiment, the distance from the convergence position SP of the combustion flame 30 to the revolving cooling water layer 56 is set long, that is, a time for performing the secondary pulverization is set long. As a result, the droplets Mmp flowing downward together with the focused jet flow 31 can be secondly pulverized efficiently, and the droplets Mmp reaching the revolving cooling water layer 56 can be the finer droplets Mmp than the method of producing a metal powder as described in the patent documents.

The droplets Mmp micronized by the secondary pulverization thrusts into the revolving cooling water layer 56 that is formed at the inner peripheral surface of the pulverization cooling cylinder 18 with low viscosity. The droplets Mmp is thirdly pulverized due to the impact that is caused when the droplets Mmp thrust into and are further micronized, and are quenched by the cooling water W, the metal powder Msp is produced.

In a case in which the combustion flame injection unit 14 is the gas injection unit as described in the patent documents, the high-pressure gas (atomized gas) is at a lower temperature than the droplets Mmp, and the jet speed of gas is also lower than the present embodiment. Therefore, the droplets Mmp generated by the secondary pulverization flow downward while being cooled, that is, flow downward while the viscosity of the droplets Mmp increases, and as a result, the droplets Mmp are not easily pulverized even if the droplets Mmp thrust into the revolving cooling water layer 56.

However, in the apparatus 10 of the present embodiment, the droplets Mmp can thrust into the revolving cooling water layer 56 together with the high-temperature and high-speed focused jet flow 31 by the combustion flame injection unitl4. That is, the droplets Mmp can thrust into the revolving cooling water layer 56 together with the focused supersonic jet flow 31 while the viscosity of the droplet Mmp decreases by heating of the jet focused flow 31. As a result, the droplets Mmp are thirdly pulverized efficiently by the impact caused when thrusting into the revolving cooling water layer 56, and the particle size of the thirdly pulverized droplets Mmp can be further micronized than the method of producing a metal powder as described in the patent documents.

According to the apparatus 10 for producing a metal powder of the present embodiment, the molten metal M is secondly pulverized until the droplets Mmp, which are firstly pulverized by the supersonic combustion flame 30, reach the revolving cooling water layer 56, and can be further thirdly pulverized by thrusting into the revolving cooling water layer 56. This makes it possible to efficiently obtain the metal powder Msp having a finer particle size than the method of producing a metal powder as described in the patent documents.

In the method of producing a metal powder as described in the patent documents, the droplets generated by the primary pulverization collide with the water layer while spreading, and as a result, the obtained metal powder is mixed with metal particles that are flown in a short distance toward the revolving cooling water layer and metal particles that are flown in a long distance toward the revolving cooling water layer. Since these metal particles are a mixture of particles obtained under different cooling conditions, quality of the metal particles, for example, amorphization, varies due to affection by the cooling rate. In the gas atomizing method described in the patent documents, since the molten metal is cooled by a gas (cooling rate is lower than the cooling by water) before being quenched by water, a part of the molten metal may be crystallized during the cooling by the gas.

However, in the apparatus 10 of the present embodiment, since the focused jet flow 31 flows downward linearly, the distance until the droplets Mmp reach the revolving cooling water layer 56 can be made almost equal. In addition, since the droplets Mmp thrust into the revolving cooling water layer 56 while being heated by the focused jet flow 31, the variation in the quality of the metal powder affected by the cooling condition can be further suppressed.

According to the apparatus 10 for producing a metal powder of the present embodiment, since the droplets Mmp that have a fine particle size due to the primary pulverization and the secondary pulverization thrust into the revolving cooling water layer 56 and are cooled, when the droplets Mmp are solidified and become the metal powder Msp, the inside of the metal powder Msp can be quenched. As a result, the inside of the metal powder Msp is uniformly amorphized, and as a result, the stably amorphized metal powder Msp can be easily obtained. Note that the amorphization state of the metal powder Msp can be confirmed by the X-ray diffraction (XRD).

The metal powder Msp obtained in this manner flows downward the pulverization cooling cylinder 18 while being dispersed in the cooling water W, and is discharged to the discharge part 32. The cooling water W containing the metal powder Msp discharged to the discharge part 32 is collected at a tip side of the pipe 50.

Note that the particle size of the metal powder Msp can be adjusted by, for example, the distance from the combustion flame injection port 28 to the revolving cooling water layer 56, the revolving speed of the cooling water W, and the like.

For example, if the distance from the combustion flame injection port 28 to the revolving cooling water layer 56 increases, the secondary pulverization is promoted, and since the particle size of the droplet Mmp reaching the revolving cooling water layer 56 decreases, the metal powder having a finer particle size can be obtained. In order to increase the distance from the combustion flame injection port 28 to the revolving cooling water layer 56, the convergence position SP of the combustion flame 30 is preferably located in the area B rather than the area A, and is more preferably located in the area C rather than the area B.

The revolving speed of the cooling water W can be adjusted by changing the amount of cooling water W jetted from the cooling water injection port 42 per unit time. By increasing the revolving speed of the cooling water W, the collision energy between the droplets Mmp and the revolving cooling water layer 56 can be increased, and as a result, the pulverization power of the tertiary pulverization is increased, and the droplets Mmp are pulverized more finely, the metal powder Msp having a finer particle size can be obtained.

Note that an inclination angle θ of the axis line CLa of the pulverization cooling cylinder 18 with respect to the vertical direction is preferably in a range from 10° to 55°. When a lower limit of an inclination angle θ is 10°, an upper end surface of the pulverization cooling cylinder 18 is sufficiently inclined. When the tip of the combustion flame injection port 28 is located above a virtual horizontal plane FP that passes through an upper end edge 18E of the pulverization cooling cylinder, the distance between the tip of the combustion flame injection port 28 and the revolving cooling water layer 56 becomes long, and the time for the secondary pulverization becomes long. The droplets Mmp are easily spheroidized, and as a result, it is possible to obtain the metal powder Msp that is close to a sphere and has a fine particle size.

When the upper limit of the inclination angle θ is 55°, for example, the cooling water W easily flows downward at the pulverization cooling cylinder 18, and as a result, the temperature of the revolving cooling water layer 56 formed by the cooling water jetted from the cooling water injection port 42 is easy to keep low. As a result, the droplets Mmp can thrust into the low-temperature revolving cooling water layer 56, and the inside of the metal powder Msp can be quenched.

As a result, the inside of the metal powder Msp can be uniformly amorphized.

As described above, by using the apparatus 10 for producing a metal powder of the present embodiment, it is possible to efficiently obtain the metal powder Msp having a finer particle size than a method of producing a metal powder as described in the patent documents.

In the apparatus 10 for producing a metal powder of the present embodiment, even if the combustion flame injection unit 14 is disposed inside the pulverization cooling cylinder 18 or the combustion flame injection unit 14 is disposed outside the pulverization cooling cylinder 18, in a case in which the combustion flame injection port 28 or the pulverization cooling cylinder 18 is housed in a closed chamber or the like, an air pressure around the droplets Mmp is likely to be asymmetrical, and a negative pressure is likely to be generated at an upstream portion of the focused jet flow 31, that is, near the convergence position SP. Since this negative pressure destabilizes the circumference of the focused jet flow 31 and the focused jet flow 31 is pulled, the vibration and the like occurs in the jet focused flow 31 flowing downward together with the droplets Mmp, and as a result, the stabilized secondary pulverization of the droplets Mmp becomes difficult. That is, there is a possibility that a variation occurs in the quality of the metal powder affected by the secondary pulverization.

In the apparatus 10 for producing a metal powder of the present embodiment, the supersonic combustion flame 30 injected from the combustion flame injection port 28 is concentrated in the open space outside the pulverization cooling cylinder 18 to form an ultra-high-speed focused jet flow 31. As a result, the generation of the negative pressure can be suppressed in the upstream portion of the focused jet flow 31, and the vibration of the focused jet flow 31 can be suppressed.

In the apparatus 10 for producing a metal powder of the present embodiment, the convergence position SP of the combustion flame 30 is preferably in the area C above the virtual horizontal plane FP that passes through the upper end edge portion 18E of the pulverization cooling cylinder 18, and an airflow can equally flow into the upstream portion of the focused jet flow 31 from all sides. Thereby, a smooth airflow is formed around the upstream portion of the focused jet flow 31, and the generation of the negative pressure can be further suppressed.

In the method of producing a metal powder as described in the patent documents, since the droplets generated by the primary pulverization flow downward while spreading, the diameter of the revolving water flow, that is, the diameter of the pulverization cooling cylinder is set to be large and it is necessary to capture the metal powder that is flown downward while spread with a large-diameter aqueous layer. However, when the diameter of the pulverization cooling cylinder increases, it is necessary to increase the capacity of the water supply source for jetting the cooling water, and the production cost of the apparatus also increases.

In the apparatus 10 for producing a metal powder of the present embodiment, the firstly pulverized droplets Mmp flow downward linearly together with the focused jet flow 31, the diameter of the pulverization cooling cylinder that captures the droplet decreases, and the apparatus 10 for producing a metal powder can be downsized. It is also easy to increase the area in which the secondary pulverization is performed.

In the present embodiment, the diameter of the combustion flame injection port 28 gradually decreases with progressing downward from the combustion chamber 26, but may be constant with progressing downward from the combustion chamber 26. In this case, the shape of the passage part 15 is not a cone but a cylinder. When the jet speed of the combustion flame 30 exceeds a sound speed, even if the diameter of the combustion flame injection port 28 is constant, the combustion flame 30 is focused at a position away from the lower end of the combustion flame injection port 28 and thus can form the focused jet flow 31.

In the gas atomizing method, the jet speed of gas is much lower than that of the combustion flame, and as a result, the jetted gas (including metal powder) greatly spreads.

TEST EXAMPLE

In order to confirm the effect of the invention, a metal powder is produced by an apparatus for producing a metal powder of an embodiment to which the invention is applied and an apparatus for producing a metal powder according to Comparative Example, respectively, and compositions and particle sizes of the produced metal powder were compared.

Description of Apparatus for Producing Metal Powder

Apparatus for Producing Metal Powder of Example

A melting part (supply unit), a combustion flame injection unit, and a pulverization part (pulverization cooling cylinder) are the same as in the above embodiment.

Water was adopted as a cooling medium to be introduced into the pulverization cooling cylinder, and a flow velocity was controlled to be about 160 m/s. The pulverized droplets thrust into a flow of water at a high speed, and a water vapor film generated on a surface of a droplet is destroyed by a water flow, and is quenched.

Apparatus for Producing Metal Powder of Comparative Example

The apparatus for producing a metal powder having the configuration disclosed in JP-A No. 2014-136807 was used.

As in the comparative example, in the apparatus for producing a metal powder, a jet burner injects a flame jet to the molten metal supplied from the supply unit and pulverizes the molten metal. The molten metal pulverized as described above was sprayed continuously using water as a cooling medium of 5 L/min by a cooling nozzle installed in a cooling chamber such that the cooling medium contacts an outer side surface of the combustion flame. The obtained powder was collected by a cyclone.

Explanation of Same Condition Portions of Example and Comparative Example

The metal to be pulverized, which consists of 6.7 wt % of Si, 2.5 wt % of Cr, 2.5 wt % of B, 0.6 wt % of C, and the balance Fe was molten in the melting part. The melting part has a stopper that can control the dropping of the molten metal from a bottom, and can control the supply of the molten metal to the pulverization part by opening the stopper.

For the combustion flame, a temperature profile along the vertical direction from the central portion of the nozzle was measured and an air-fuel ratio thereof was controlled to be 1.2 such that a maximum value of the temperature profile was about 1200° C. The molten metal was dropped at 3 kg/min.

Figure 4A:
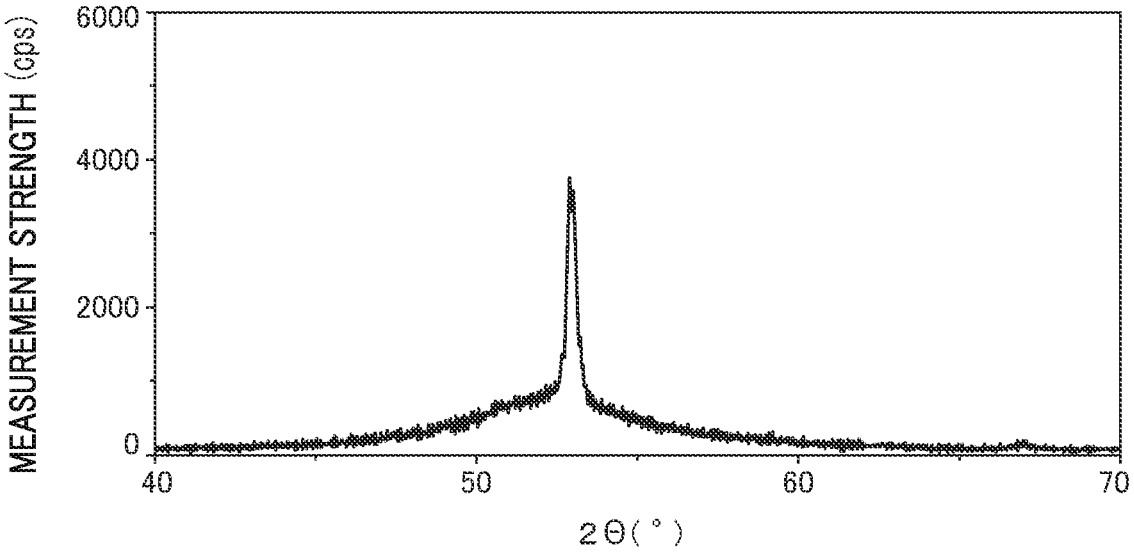
FIG. 4A is a graph showing an X-ray diffraction result of a metal powder produced with an apparatus for producing a metal powder according to Comparative Example.
Figure 4B:
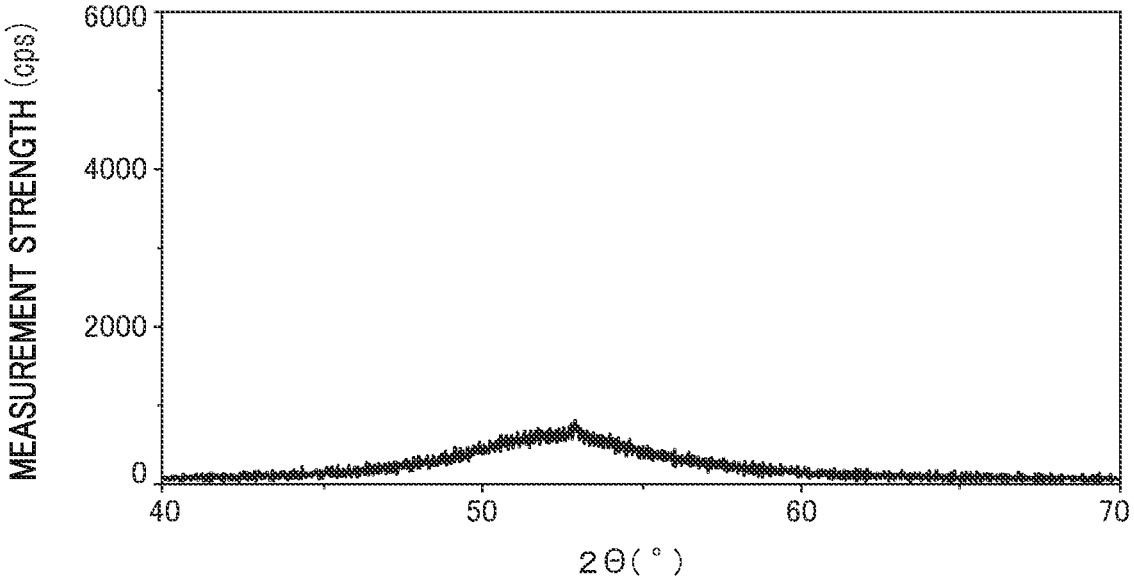
FIG. 4B is a graph showing an X-ray diffraction result of a metal powder produced with an apparatus for producing a metal powder according to an example of the present invention.

FIG. 4A is a graph showing a test result by an X-ray diffraction of a metal powder produced by the apparatus for producing a metal powder according to Comparative Example, and FIG. 4B is a graph showing test results by an X-ray diffraction of a metal powder produced by the apparatus for producing a metal powder according to Example.

From the test results shown in FIG. 4A, it can be seen that the metal powder produced by the apparatus according to Comparative Example contains a partially crystallized metal powder (in FIG. 4A, there is a Fe peak). It can be seen from the test results shown in FIG. 4B that the metal powder produced by the apparatus according to Example is completely amorphized (there is no peak as shown in the test results of Comparative Example).

Figure 5A:
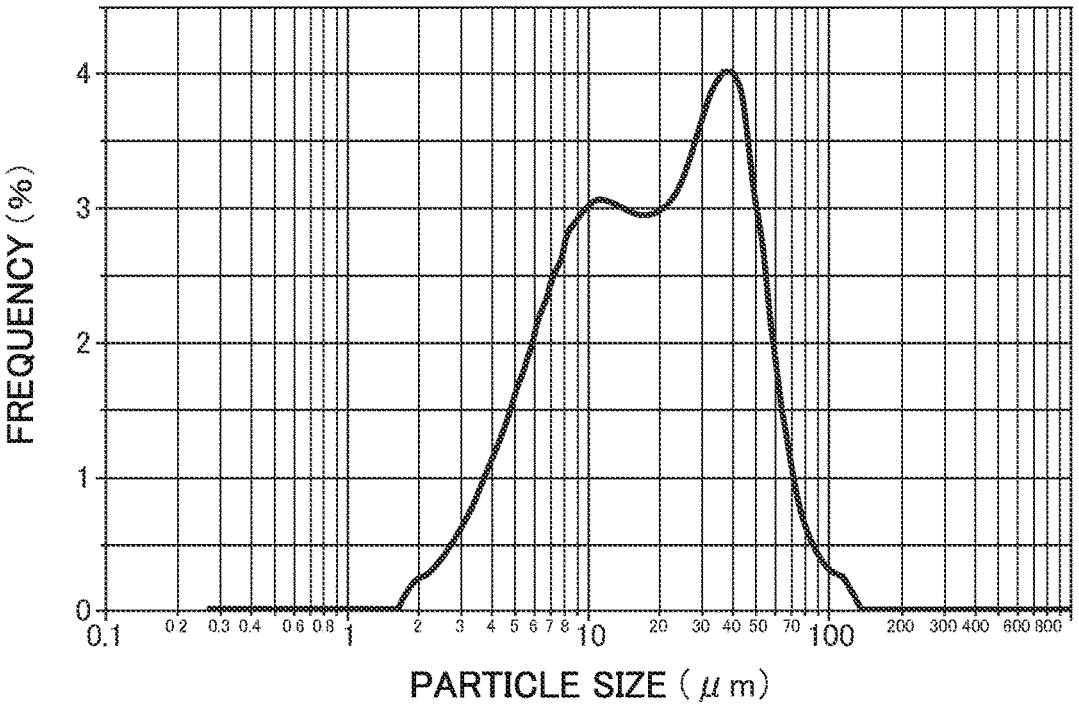
FIG. 5A is a graph showing a particle size distribution of the metal powder produced with the apparatus for producing a metal powder according to Comparative Example.
Figure 5B:
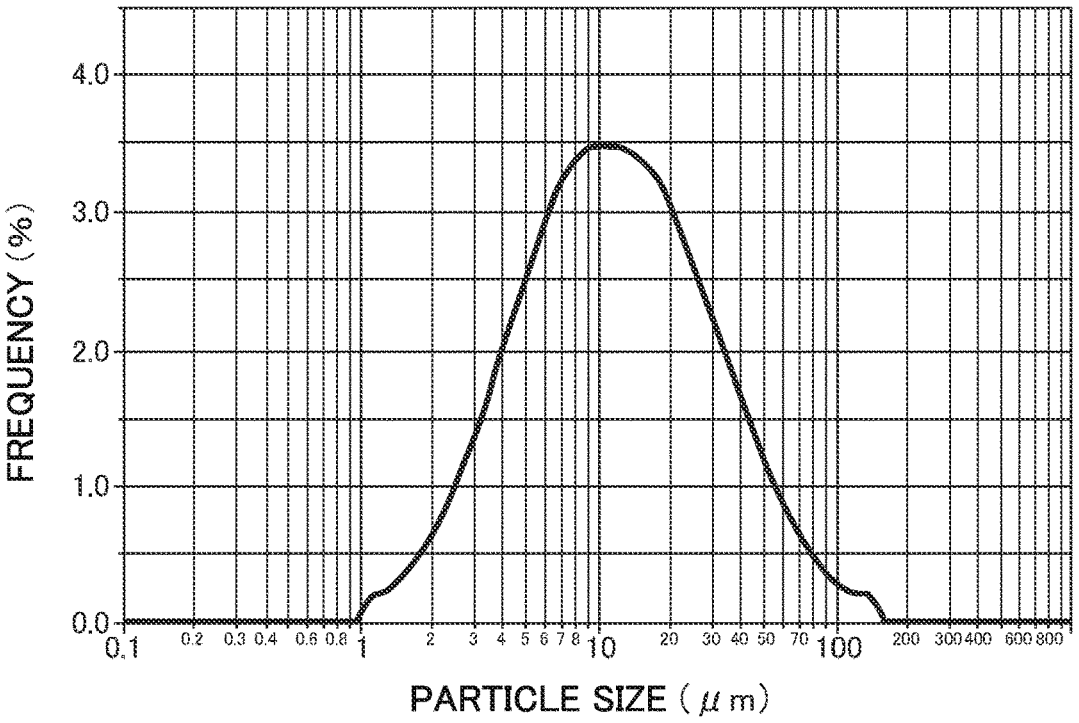
FIG. 5B is a graph showing a particle size distribution of the metal powder produced with the apparatus for producing a metal powder according to an example of the present invention.

FIG. 5A is a graph showing a particle size distribution of a metal powder produced by the apparatus according to Comparative Example, and FIG. 5B is a graph showing a particle size distribution of a metal powder produced by the apparatus according to Example.

It can be seen from the test results shown in FIGS. 5A and 5B that comparing the metal powder produced by the apparatus according to Example with the metal powder produced by the apparatus according to Comparative Example, a generation of a powder having a large particle size is suppressed, and the metal powder according to Example is pulverized into a particle size distribution having a relatively small average particle size.

Other Embodiments

As described above, one embodiment of the present invention has been described, but the invention is not limited thereto. It is needless to say that various modifications can be made without departing from the scope of the invention in addition to the above description.

In the embodiment, the droplets Mmp generated by the secondary pulverization is thirdly pulverized by colliding with the revolving cooling water layer 56. The droplets Mmp generated by the secondary pulverization or the metal powder Msp in which the droplets Mmp is solidified may collide with the inner peripheral surface of the pulverization cooling cylinder 18 by being carried at the revolving cooling water layer 56 and thus thirdly pulverized by the impact at that time. Thereby, the pulverization force can be further increased, and the metal powder having a finer particle size can be obtained.

In the apparatus 10 for producing a metal powder of the present embodiment, for example, an inert gas such as an argon gas containing no oxygen or a nitrogen gas may flow into the pulverization cooling cylinder 18. The oxidation of the metal can be suppressed.

The disclosure of Japanese Patent Application No. 2017-172411 filed on Sep. 7, 2017 is incorporated herein by reference in its entirety.

All publications, patent applications, and technical standards described herein are incorporated by reference herein to the same extent as if specifically and individually stated to be incorporated by reference.

The invention claimed is:

1. An apparatus for producing a metal powder, comprising:

a supply unit that downwardly supplies a molten metal;

a combustion flame injection unit that convergently injects a supersonic combustion flame from a combustion flame injection port to the molten metal supplied from the supply unit and jets the convergent combustion flame as a focused jet flow directly downward; and a pulverization device having a pulverization cooling cylinder that forms a revolving water flow along an inner peripheral wall of the pulverization cooling cylinder, which has an axis line that is inclined relative to a vertical direction, and that thrusts the focused jet flow inflowing from an upper opening into the revolving water flow, wherein a convergence position of the combustion flame is (1) in an open space above the opening; (2) above the axis line of the pulverization cooling cylinder; and, (3) above a virtual horizontal plane passing through an upper end edge of the pulverization cooling cylinder.

2. The apparatus for producing a metal powder according to claim 1, wherein the convergence position is within a range of 15 to 120 mm from a lower end of the combustion flame injection port.

3. The apparatus for producing a metal powder according to claim 1, wherein:

an inclination angle of the axis line of the pulverization cooling cylinder with respect to the vertical direction is from 10° to 55°, and a tip of the combustion flame injection port is above a virtual horizontal plane passing through an upper end edge of the pulverization cooling cylinder.

* * * * *